US007728569B1

(12) United States Patent
Le et al.

(10) Patent No.: US 7,728,569 B1
(45) Date of Patent: Jun. 1, 2010

(54) VOLTAGE REGULATOR CIRCUITRY WITH ADAPTIVE COMPENSATION

(75) Inventors: Thien Le, San Jose, CA (US); Ping-Chen Liu, Fremont, CA (US)

(73) Assignee: Altera Corporation, San Jose, CA (US)

( * ) Notice: Subject to any disclaimer, the term of this patent is extended or adjusted under 35 U.S.C. 154(b) by 240 days.

(21) Appl. No.: 11/786,312

(22) Filed: Apr. 10, 2007

(51) Int. Cl.
*G05F 1/00* (2006.01)
*G05F 1/10* (2006.01)

(52) U.S. Cl. ..... 323/280; 327/538

(58) Field of Classification Search ..... 323/282, 323/280; 327/538–543
See application file for complete search history.

(56) References Cited

U.S. PATENT DOCUMENTS 6,208,127 B1 3/2001 Doluca
6,285,614 B1 9/2001 Mulatti et al.
6,473,280 B1 10/2002 Buxton et al.
6,600,692 B2 7/2003 Tanzawa
7,071,664 B1 7/2006 Teggatz et al.
7,132,880 B2 11/2006 Ingino, Jr.
2005/0040799 A1* 2/2005 Pannwitz ..... 323/282
2005/0140340 A1* 6/2005 Pai et al. ..... 320/166
2008/0169795 A1* 7/2008 Wang ..... 323/280

* cited by examiner

*Primary Examiner*—Bao Q Vu
*Assistant Examiner*—Jue Zhang
(74) *Attorney, Agent, or Firm*—Treyz Law Group; G. Victor Treyz; David C. Kellogg

(57) ABSTRACT

Voltage regulator circuitry is provided. The voltage regulator circuitry may contain a drive transistor that is controlled by the output of an operational amplifier. The drive transistor may supply a regulated voltage to a load. The operational amplifier may compare a reference voltage and a feedback signal at its inputs. The operational amplifier may include first and second stages. An adjustable resistor may be provided between the first and second stages. Control circuitry may control the resistance of the adjustable resistor based on the amount of current flowing through the load to ensure stable operation of the voltage regulator circuitry. Overshoot and undershoot detection and compensation circuitry may compensate for overshoot and undershoot in the regulated voltage. Voltage ramp control circuitry may be used to control the ramp rate of the regulated voltage.

20 Claims, 6 Drawing Sheets

VOLTAGE REGULATOR CIRCUITRY WITH ADAPTIVE COMPENSATION

BACKGROUND

This invention relates to power regulator circuitry, and more particularly, to power regulator circuitry for powering loads on integrated circuits such as programmable logic device integrated circuits.

Integrated circuits such as programmable logic devices often contain voltage regulators. For example, voltage regulators may be used to control the magnitude of a power supply voltage. In on-chip applications such as these it is desirable for a voltage regulator to exhibit good performance without consuming an excessive amount of circuit real estate.

Programmable logic devices are a type of integrated circuit that can be customized in relatively small batches to implement a desired logic design. In a typical scenario, a programmable logic device manufacturer designs and manufactures uncustomized programmable logic device integrated circuits in advance. Later, a logic designer uses a logic design system to design a custom logic circuit. The logic design system uses information on the hardware capabilities of the manufacturer's programmable logic devices to help the designer implement the logic circuit using the resources available on a given programmable logic device.

The logic design system creates configuration data based on the logic designer's custom design. The configuration data may be loaded into programmable memory elements on a programmable logic device to program the logic of the programmable logic device so that the programmable logic device implements the designer's logic circuit. The use of programmable logic devices can significantly reduce the amount of effort required to implement a desired integrated circuit design.

A voltage regulator may be used to produce a power supply voltage for programmable memory elements on a programmable logic device. During device operation, the power supply voltage for the programmable memory elements may be subject to noise induced by nearby capacitively coupled core logic. The programmable memory elements may also be sensitive to the rate at which the power supply voltage at the output of the regulator is applied during operations such as powering up the device.

It would be desirable to be able to provide a voltage regulator circuit that is able to produce accurate and well-controlled voltages without consuming excessive amounts of circuit real estate on an integrated circuit such as a programmable logic device.

SUMMARY

In accordance with the present invention, voltage regulator circuitry is provided. The voltage regulator circuitry may provide a regulated voltage output on an integrated circuit such as a programmable logic device integrated circuit. Programmable logic device integrated circuits may contain programmable memory elements. The regulated voltage that is produced by the voltage regulator circuit may be applied to the programmable memory elements as a power supply voltage or may be applied to other loads.

The voltage regulator circuitry may contain an operational amplifier. The operational amplifier may have inputs and an output at which a control signal is generated. The control signal may be applied to the gate of a drive transistor. The drive transistor may be implemented as a single transistor or as a set of parallel transistors. The drive transistor may be connected between a power supply terminal and an output node. The regulated voltage may be supplied at the output node. The load may be connected between the output node and ground.

A voltage divider may be connected between the output node and ground. A feedback signal that is tapped from the voltage divider may be fed back to one of the inputs of the operational amplifier. The other input of the operational amplifier may receive a reference voltage.

The operational amplifier may contain first and second stages. An adjustable resistor between the first and second stages may be used to enhance the stability of the voltage regulator. During operation, sensing and control circuitry may determine how much current is flowing through the load and may adjust the resistance of the adjustable resistor accordingly. The adjustable resistor may include multiple resistors. At least one of these resistors may be bridged by a transistor. The sensing and control circuitry may supply transistor control signals to the gates of the bridging transistors to adjust the resistance of the adjustable resistor.

Overshoot and undershoot detection and compensation circuitry may be used to determine when the regulated voltage is overshooting or undershooting a desired level and may help to maintain the regulated voltage at its desired level.

Ramp rate control circuitry may control the rate at which the regulated voltage ramps up during power up operations.

Further features of the invention, its nature and various advantages will be more apparent from the accompanying drawings and the following detailed description.

DETAILED DESCRIPTION

The present invention relates to voltage regulator circuitry. The voltage regulator circuitry may be used to regulate any suitable voltage. A scenario in which the voltage regulator circuitry is used to produce a power supply voltage for programmable memory elements on a programmable logic device integrated circuit is sometimes described herein as an example. In general, however, the voltage regulator circuitry may be used on any suitable integrated circuits such as memory chips, digital signal processing circuits, microprocessors, application specific integrated circuits, or any other suitable integrated circuits. The use of the voltage regulator circuitry to regulate a power supply voltage for programmable memory elements on a programmable logic device integrated circuits is merely illustrative.

Figure 1:
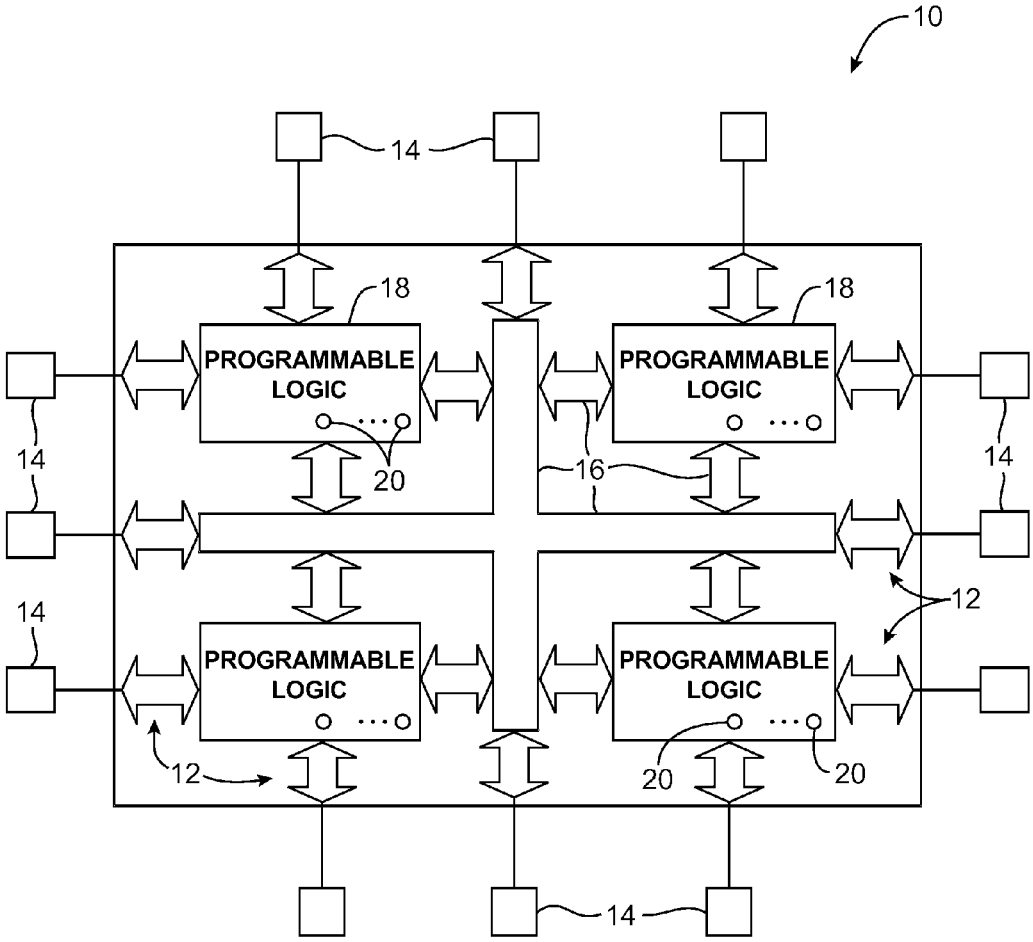
FIG. 1 is a diagram of an illustrative programmable logic device integrated circuit that may have voltage regulator circuitry in accordance with an embodiment of the present invention.

An illustrative programmable logic device 10 that may contain voltage regulator circuitry in accordance with the present invention is shown in FIG. 1.

Programmable logic device 10 may have input/output circuitry 12 for driving signals off of device 10 and for receiving signals from other devices via input/output pins 14. Interconnection resources 16 such as global and local vertical and horizontal conductive lines and buses may be used to route signals on device 10. Interconnection resources 16 include fixed interconnects (conductive lines) and programmable interconnects (i.e., programmable connections between respective fixed interconnects). Programmable logic 18 may include combinational and sequential logic circuitry. The programmable logic 18 may be configured to perform a custom logic function. The programmable interconnects associated with interconnection resources may be considered to be a part of programmable logic 18.

Programmable logic device 10 contains programmable memory elements 20 that can be loaded with configuration data (also called programming data) using pins 14 and input/output circuitry 12. Once loaded, the memory elements each provide a corresponding static control output signal that controls the state of an associated logic component in programmable logic 18.

The memory element output signals are typically used to control the gates of metal-oxide-semiconductor (MOS) transistors. Most of these transistors are generally n-channel metal-oxide-semiconductor (NMOS) pass transistors in programmable components such as multiplexers. When a memory element output is high, the pass transistor controlled by that memory element is turned on and passes logic signals from its input to its output. When the memory element output is low, the pass transistor is turned off and does not pass logic signals. P-channel metal-oxide-semiconductor (PMOS) transistors may also be controlled by the memory elements. The memory elements may be loaded from any suitable source. For example, the memory elements may be loaded from an external erasable-programmable read-only memory and control chip called a configuration device via pins 14 and input/output circuitry 12.

The memory elements 20 are generally arranged in an array pattern. In a typical modern programmable logic device, there may be millions of memory elements 20 on each chip.

The circuitry of device 10 may be organized using any suitable architecture. As an example, the logic of programmable logic device 10 may be organized in a series of rows and columns of larger programmable logic regions each of which contains multiple smaller logic regions. The logic resources of device 10 may be interconnected by interconnection resources 16 such as associated vertical and horizontal conductors. These conductors may include global conductive lines that span substantially all of device 10, fractional lines such as half-lines or quarter lines that span part of device 10, staggered lines of a particular length (e.g., sufficient to interconnect several logic areas), smaller local lines, or any other suitable interconnection resource arrangement. If desired, the logic of device 10 may be arranged in more levels or layers in which multiple large regions are interconnected to form still larger portions of logic. Still other device arrangements may use logic that is not arranged in rows and columns.

Figure 2:
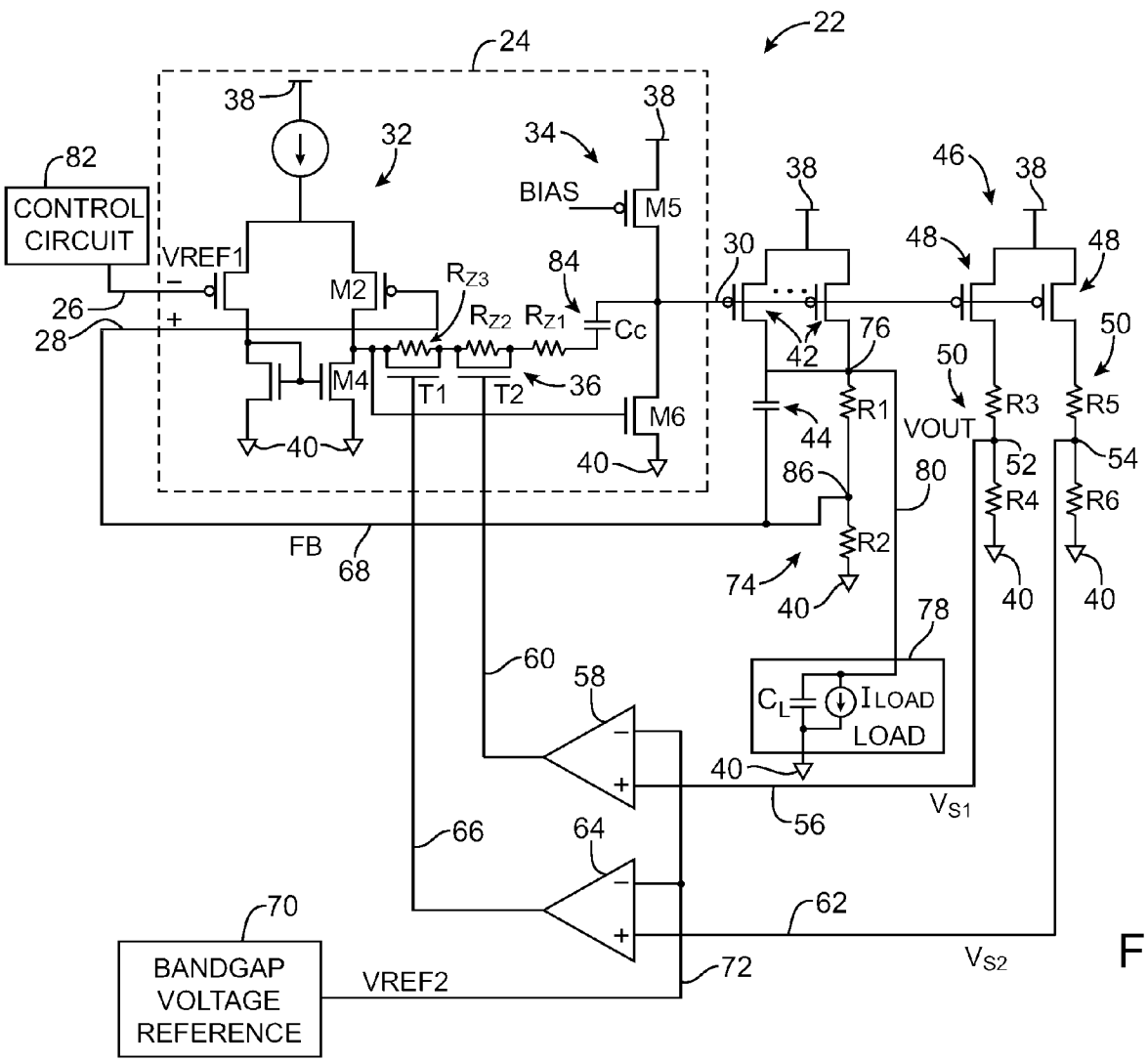
FIG. 2 is a diagram of a voltage regulator circuit with adaptive compensation circuitry that may be used to power a load such as a load formed from programmable memory elements on a programmable logic device integrated circuit in accordance with an embodiment of the present invention.

Voltage regulator circuitry 22 in accordance with the present invention is shown in FIG. 2. Circuitry 22 may be powered by one or more positive power supply voltages applied to positive power supply terminals 38 and a ground power supply voltage applied to ground terminals 40.

Voltage regulator circuitry 22 has an operational amplifier 24. Operational amplifier 24 compares input signals that are received at negative input 26 and positive input 28 and produces a corresponding output signal at output 30. Operational amplifier 24 has a first stage 32 and a second stage 34. Adjustable compensation resistor 36 and compensation capacitor 84 form a tuning network that is interposed between stages 32 and 34. Resistor 36 and capacitor 84 serve to adjust the frequency response of operational amplifier 24 and voltage regulator circuitry 22.

Resistor 36 has multiple resistor segments. In general, resistor 36 may be formed from any suitable collection of resistors, which may be connected in parallel or in serial. In the example of FIG. 2, adjustable resistor 36 is formed from three resistors—resistors Rz1, Rz2, and Rz3. Resistor Rz1 is a fixed resistor. Resistors Rz2 and Rz3 are bridged by n-channel metal-oxide-semiconductor (NMOS) transistors T2 and T1, respectively. During operation of circuitry 22, control signals are applied to the gates of transistors T1 and T2 that turn transistors T1 and T2 on and off. When these transistors are turned on, resistors Rz2 and Rz3 are bypassed, which reduces the overall resistance of resistor 36. When these transistors are turned off, resistor 36 has a resistance equal to the series resistance of all three resistors—i.e., Rz1+Rz2+Rz3.

The output 30 of operational amplifier 24 is applied to the gate of p-channel metal-oxide-semiconductor (PMOS) drive transistors 42. Transistors 42 may be connected in parallel between positive power supply terminal 38 and output node 76. The output voltage Vout of voltage regulator circuitry 22 may be supplied on output line 80. A load 78 may be connected to output line 80. Load 78 may be any suitable circuit load. For example, load 78 may be all or part of an array of programmable memory elements 20 on a programmable logic device 10. The use of multiple parallel transistor structures 42 may be advantageous in situations in which it is desirable to drive large currents into load 78. The maximum size of a drive transistor on device 10 may be limited by semiconductor fabrication design rules, so large currents may only be achievable using parallel arrangements. If desired, a single drive transistor 42 may be used.

Compensation capacitors such as compensation capacitor 44 may be used to improve the high frequency performance of voltage regulator circuitry 22.

A voltage divider 74 may be connected in series with transistors 42 between positive power supply terminal 38 and ground terminal 40. The values of resistors R1 and R2 may be equal, so that the voltage at node 86 is one half of the output voltage Vout (as an example). The voltage at node 86 forms a feedback signal FB that is fed back to input 28 of operational amplifier 24 over feedback path 68.

Operational amplifier 24 receives signal FB on input 28 and receives a reference voltage VREF1 from control circuit 82 on input 26. Control circuit 82 may be any suitable circuitry for providing a voltage reference signal to operational amplifier 24. For example, control circuit 82 may use a reference voltage from a bandgap voltage reference such as bandgap voltage reference 70 to produce a fixed or time-varying reference voltage signal VREF1 on its output. If desired, a time-varying reference voltage may be used to create a power supply voltage Vout on output line 80 that powers load 78 at different levels during different modes of operation for programmable logic device integrated circuit 10.

Path 68 forms a feedback loop in circuitry 22. If the output voltage Vout on node 76 and line 80 rises above a desired value, the voltage on feedback node 86 in voltage divider 74 will rise above VREF1. If the voltage Vout falls below its desired value, the voltage FB will fall below VREF1. Operational amplifier 24 compares the voltages on its positive and negative inputs and produces a corresponding control signal on output 30 that is applied to the gates of drive transistors 42.

When feedback signal FB on node 86 rises above VREF1, the control signal on line 30 is increased by operational amplifier 24. The control signal is applied to the gate of transistors 42. Because transistors 42 are PMOS transistors, the increasing control signal voltage on line 30 results in an increase in the source-drain resistances of transistors 42. As the resistances of transistors 42 increase, the magnitude of the voltage at node 76 (regulated voltage Vout) and the magnitude of the voltage at node 86 (feedback voltage FB) are reduced until FB is less than VREF1 and Vout has reached its desired voltage level.

When output voltage Vout falls below its desired set point, the feedback signal FB will fall below VREF1. When feedback signal FB falls below VREF1, operational amplifier 24 will decrease the control voltage on the gates of transistors 42. This will decrease the source-drain resistance of transistors 42. As the resistances of transistors 42 decrease, the power supply voltage Vout will rise to its desired level and the feedback signal FB will rise to VREF1.

Control circuitry 82 may change the value of VREF1 in real time depending on the operating mode of programmable logic device 10. In this type of scenario, the operational amplifier 24 and other circuitry of regulator 22 will produce time-varying values of the voltage Vout at output 80.

Load 78 may be formed by an array of programmable memory elements 20. As shown in FIG. 2, load 78 may be characterized by a capacitance $C_L$ and a load current $I_{LOAD}$. The amount of current $I_{LOAD}$ that is drawn by load 78 may fluctuate due to fabrication process variations, operating voltage variations, and temperature variations.

Voltage regulator 22 uses an adaptive compensation scheme to ensure system stability under a wide range of conditions. In particular, the adaptive compensation scheme of voltage regulator 22 adjusts the resistance of adjustable resistor 36 in real time to ensure that regulator 22 will exhibit stable operation under a range of load currents $I_{LOAD}$.

Figure 3:
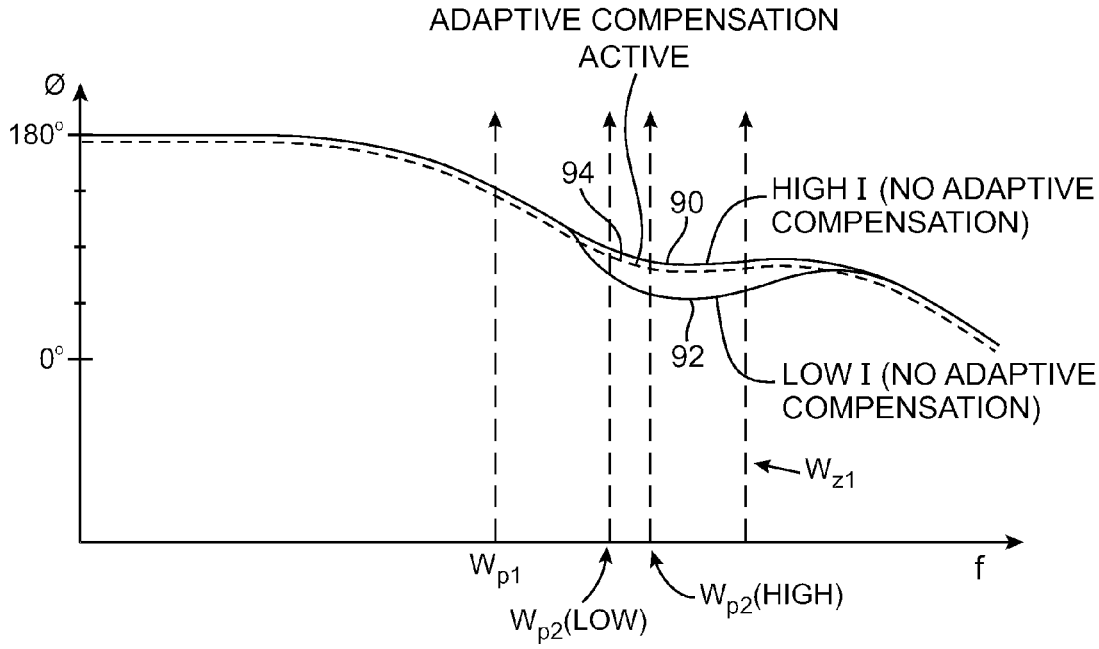
FIGS. 3 and 4 are graphs showing the open-loop frequency response of a voltage regulator circuit in accordance with an embodiment of the present invention.
Figure 4:
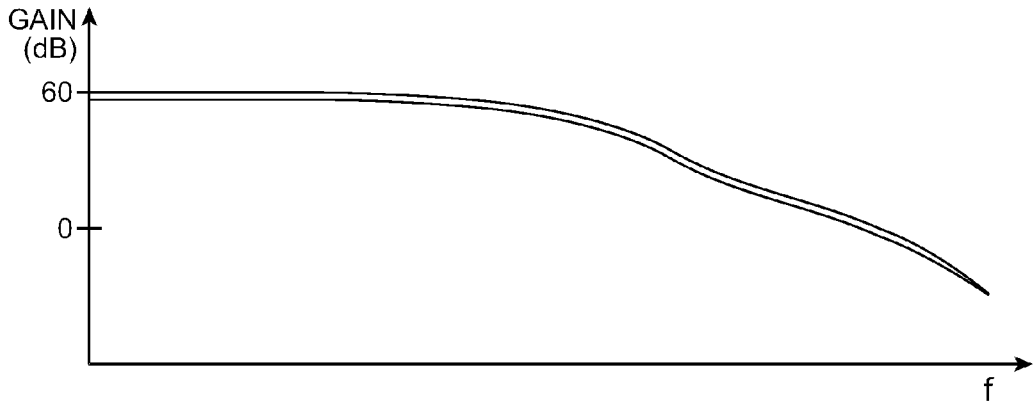

The performance of circuitry 22 may be modeled mathematically. Illustrative phase and gain plots showing the frequency response of voltage regulator circuitry 22 under a variety of operating conditions are shown in FIGS. 3 and 4. The voltage regulator circuitry has a first (dominant) pole Wp1, a second pole Wp2, and a zero Wz1.

The frequency associated with pole Wp1 is given in equation 1.

$$Wp1=(1/g_{m_M6})*Ra*Rb*Cc \quad (1)$$

In equation 1, $g_{m_M6}$ is the transconductance of transistor M6 in output stage 34 of operational amplifier 24. The term Ra represents the small signal source-drain resistance of transistor M2 taken in parallel with the small signal source-drain resistance of transistor M4. The term Rb represents the small signal source-drain resistance of transistor M5 taken in parallel with the small signal source-drain resistance of transistor M6. The term Cc represents the capacitance of capacitor 84.

The frequency associated with pole Wp2 is given in equation 2.

$$Wp2=g_{ds_Mpt}/C_{LOAD} \quad (2)$$

In equation 2, the term $g_{ds_Mpt}$ is the transconductance of drive transistors 42 and $C_{LOAD}$ is the capacitance of load 78.

The frequency associated with the zero Wz1 is given in equation 3.

$$Wz1=1/Cc(1/g_{m_M6}-Rz) \quad (3)$$

In equation 3, the term Cc represents the capacitance of capacitor 84, $g_{m_M6}$ represents the transconductance of transistor M6, and Rz represents the resistance of resistor 36. For stable operation, the value of Rz is preferably selected to be larger than $1/g_{m_M6}$ as this ensures that Wz1 will be located in the left-half plane in the vicinity of pole Wp2 where Wz1 will produce a positive phase contribution that will cancel the negative phase contribution of Wp2.

In order for voltage regulator 22 to exhibit good stability (good phase margin), its phase plot must exhibit a significant non-negative phase at the frequency at which its gain drops to 0 dB. When zero Wz1 is located close to pole Wp2, zero Wz1 tends to cancel out the attributes of pole Wp2, which increases the phase margin of circuitry 22 and thereby improves its stability.

The value of $g_{ds_Mpt}$ in equation 2 is proportional to the current $I_{LOAD}$. As a result, the position of pole Wp2 varies as a function of $I_{LOAD}$, as shown in FIG. 3. In the absence of adaptive compensation (i.e., if the value of resistor 36 is not altered as a function of load current), the change in the position of Wp2 will alter the phase characteristic of circuit 22. Under high current conditions, the position of Wp2 will be given by Wp2(high) and (in the absence of active compensation) the phase plot will follow line 90, whereas under low current conditions, the position of Wp2 will be given by Wp2(low) and (in the absence of active compensation) the phase plot will follow line 92. Line 92 is lower in phase than line 90, demonstrating how circuitry 22 may exhibit reduced phase margin at low currents when the adaptive compensation scheme of FIG. 2 is not employed.

When the adaptive compensation scheme of FIG. 2 is active, the position of zero Wz1 moves as a function of current, tracking the movements of pole Wp2. This allows the performance characteristics that are associated with pole Wp2 to be effectively cancelled out by zero Wz1 under a wide range of load currents. Dotted line 94 represents the performance of circuitry 22 under a both high and low load currents $I_{LOAD}$ when adaptive compensation is active. As shown by dotted line 94 of FIG. 3, when the adaptive compensation capabilities of circuitry 22 are active, circuitry 22 exhibits good phase margin under a wide range of load currents.

Adaptive compensation is provided in circuitry 22 by sensing the load current $I_{LOAD}$ and by adjusting the resistor 36 accordingly. As shown in FIG. 3, pole Wp2 will move to lower frequencies as load current drops and will move to higher frequencies as load current rises. The resistance of resistor 36 in the tuning network in operational amplifier 24 may be adjusted in real time to compensate for the movement of pole Wp2. When pole Wp2 moves to lower frequencies at low load currents, the position of zero Wz1 may be moved to lower frequencies to compensate by increasing the value of Rz. When pole Wp2 moves to higher frequencies at high load currents, the position of zero Wz1 may be moved to higher frequencies to compensate by decreasing the value of Rz.

The value of the load current $I_{LOAD}$ may be sensed using any suitable sensing circuitry. In the example of FIG. 2, the load current is sensed using current sensing circuitry 46. Current sensing circuitry 46 may have multiple current sensing branches. In the example of FIG. 2, there is a left-hand current sensing branch and a right-hand current sensing branch. If desired, there may be more than two current sensing branches.

Each current sensing branch of current sensing circuitry 46 may have an associated p-channel metal-oxide-semiconductor transistor 48 that forms a current mirror with transistors 42 and an associated voltage divider 50. The current mirror transistors may have any suitable strength relative to transistors 42. For example, a 100:1 current mirror ratio may be used so that the current Is flowing through the branches of circuitry 46 is about 1/100th of the total drain-source current $I_{LOAD}$ flowing through transistors 42.

The voltage divider 50 in each current sensing branch of circuitry 46 may have a set of resistors that establishes a different current sensing threshold for that branch. For example, the left-hand branch of circuitry 46 may have resistors R3 and R4 and the right-hand branch of circuitry 46 may have resistors R5 and R6. Resistors R3 and R4 may be connected in series with a transistor 48 between a positive power supply terminal 38 and a ground terminal 40. Resistors R5 and R6 in the right-hand voltage divider 50 may be connected in series with another transistor 48 between positive power supply terminal 38 and a ground terminal 40.

Resistors R3 and R4 are connected at node 52. Resistors R5 and R6 are connected at node 54. Path 56 conveys the voltage at node 52 to a positive input terminal associated with comparator 58, whereas path 62 conveys the voltage at node 54 to a positive input terminal associated with comparator 64.

A voltage reference circuit such as bandgap voltage reference 70 may provide a reference voltage VREF2 on path 72. Comparators 58 and 64 may receive the voltage VREF2 at their negative input terminals. Each comparator compares the signal on its positive input terminal to the signal on its negative input terminal and produces a corresponding high or low digital output signal at its output. The output signal on path 60 serves as a control signal for transistor T2, whereas the output signal on path 66 serves as a control signal for transistor T1.

During operation of voltage regulator circuitry 22, a load current $I_{LOAD}$ flows through transistors 42 into load 78. The load current may (as an example) be due to leakage currents in an array of programmable memory elements 20 on programmable logic device 10. As load current $I_{LOAD}$ flows through transistors 42, a proportional sensed current flows through sensing circuitry 46 and, in accordance with the resistances of the resistors in each voltage divider 50, voltages Vs1 and Vs2 develop at the voltage divider nodes 52 and 54.

Figure 5:
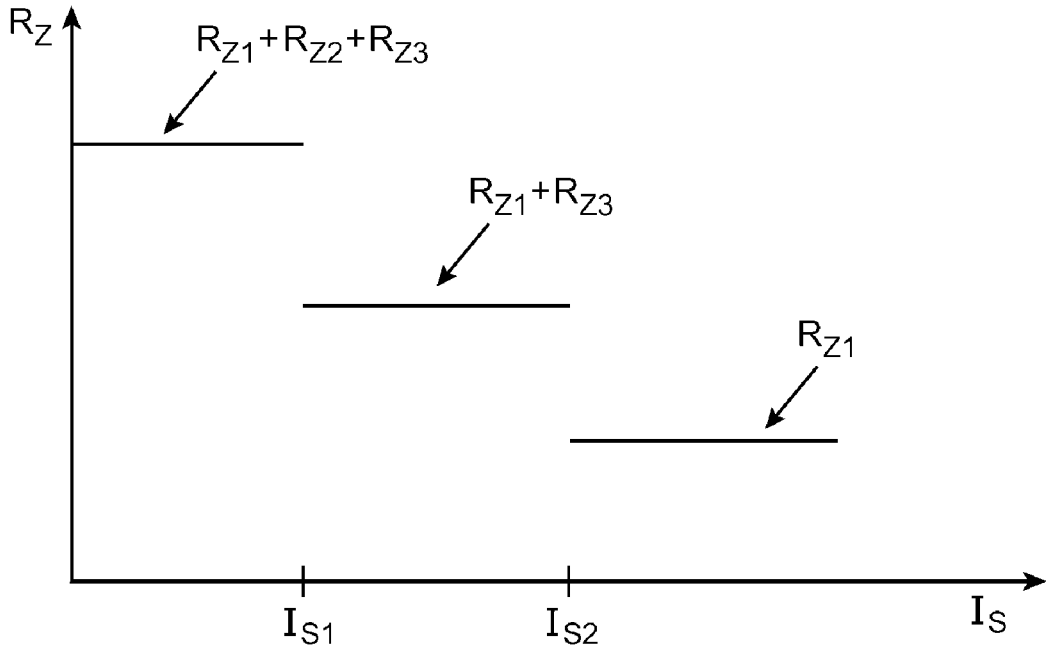
FIG. 5 is a graph showing how the magnitude of a compensation resistance in a voltage regulator can be adjusted based on sensed drive current in accordance with an embodiment of the present invention.

If the load current $I_{LOAD}$ and the sensed current Is is low (e.g., below Is1 of FIG. 5), the voltage Vs1 at node 52 will be below VREF2 and the voltage Vs2 at node 54 will be below VREF2. In this situation, the outputs of comparators 58 and 64 will both be low. With lines 60 and 66 and the gates of transistors T1 and T2 in adjustable resistor 36 low, transistors T1 and T2 will be off and the resistance of resistor 36 will be Rz1+Rz2+Rz3, as shown in FIG. 5.

If the load current has a higher value, so that the sensed current Is has a value between Is1 and Is2, the voltage Vs1 will be above VREF2 and the voltage Vs2 will be below VREF2. In this situation, the output of comparator 58 will be high and the output of comparator 64 will be low. The high output of comparator 58 will turn transistor T2 on, whereas the low output of comparator 64 will turn transistor T3 off. When transistor T2 is turned on, a bypass path is formed around resistor Rz2. With resistor Rz2 shorted out in this way, the resistance Rz of adjustable resistor 36 will be equal to Rz1+Rz3, as shown in FIG. 5.

At large values of load current, the sensed current Is will have a value above Is2 and both the voltages Vs1 and Vs2 will exceed VREF2. In this situation, the output of both comparator 58 and comparator 64 will be high and transistors T1 and T2 will both be on. Turning transistors T1 and T2 on bypasses resistors Rz3 and Rz2 in adjustable resistor 36, so that the resistance of adjustable resistor 36 will be equal to Rz1, as shown in FIG. 5.

In the example of FIG. 2, there are two current sensing branches in current sensing circuitry 46, two corresponding comparators that compare the voltage outputs of the current sensing circuits to a fixed reference voltage, and two corresponding transistors in adjustable resistor 36 that are turned on or off depending on the magnitude of the load current. If desired, there may be more than two branches in circuitry 46, more than two comparators, and more than two transistors in the adjustable resistor in operational amplifier 24 to provide a higher degree of precision when controlling the resistance of resistor 36. The use of two branches, two comparators, and two transistors is merely illustrative.

To minimize current consumption by operational amplifier 24, it may be desirable to form operational amplifier from low-current circuitry. Such low-current circuitry may respond slowly under heavy loads and, in the absence of corrective action, may cause the operational amplifier output signal to experience overshoot and undershoot. To counteract these loading effects, operational amplifier 24 may be provided with ancillary overshot and undershoot circuits that do not increase operational amplifier's DC current. When an overshoot or undershoot condition is detected, the ancillary circuitry may help to correct the output voltage.

Figure 6:
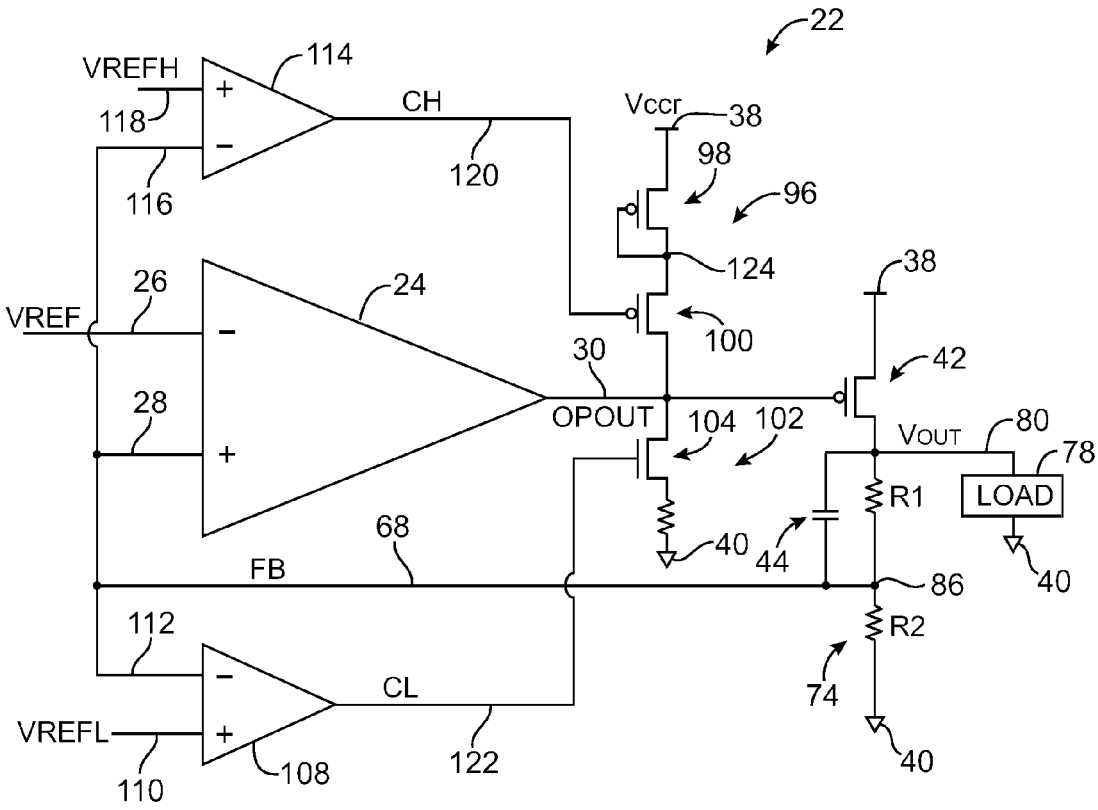
FIG. 6 is a diagram of an illustrative voltage regulator with undershoot and overshoot detectors in accordance with an embodiment of the present invention.

An illustrative embodiment of voltage regulator circuitry 22 with overshoot and undershoot compensation circuitry is shown in FIG. 6.

As shown in FIG. 6, voltage regulator circuitry 22 may have an overshoot comparator 114 and an undershoot comparator 108. Operational amplifier 24 may receive a reference voltage VREF at input 26. A slightly higher reference voltage VREFH may be received by overshoot comparator 114 at input 118 and a slightly lower reference voltage VREFL may be received by undershoot comparator 108 at input 110. Reference voltages VREF, VREFH, and VREFL may be provided by any suitable reference voltage circuitry such as a voltage reference circuit based on a bandgap voltage reference. Illustrative voltages that may be used for VREF, VREFH, and VREFL are 0.8 volts, 0.9 volts, and 0.7 volts (as examples).

The output OPOUT of operational amplifier 24 is applied to the gate of drive transistor 42. Voltage divider circuit 74 is connected in series with drive transistor 42 between positive power supply voltage terminal 38 and ground terminal 40. Load 78 is provided with output voltage Vout on output path 80. Compensation capacitor 44 may help to improve system stability.

Feedback voltage FB is tapped from node 86 in voltage divider 74 and is fed back to input 28 of operational amplifier 24. Operational amplifier 24 compares the feedback voltage FB to the reference voltage VREF and produces a corresponding output signal OPOUT on path 30.

If the voltage Vout rises above its desired voltage level, the feedback voltage FB will rise above VREF. Operational amplifier 24 will then produce an increased value of OPOUT on line 30. This will tend to turn transistor 42 off and lower Vout towards its desired level.

If the voltage Vout falls below its desired level, the feedback voltage FB will fall below VREF. In response, operational amplifier 24 will decrease the magnitude of signal OPOUT. This will turn on transistor 42 more strongly and will cause Vout to rise towards its desired level.

Transistor 42 may be implemented as a single transistor or as multiple parallel transistors. There is a parasitic capacitance associated with the gate of transistor 42 and path 30. It may be desirable to construct operational amplifier 24 so that it occupies a minimal amount of space on programmable logic device integrated circuit 10. In this type of arrangement, the current driving capabilities of operational amplifier 24 will be limited. The limited current capabilities of operational amplifier 24 and the parasitic capacitance of drive transistor 42 will limit the ability of voltage regulator to respond to transients. As a result, there will be a tendency of the output signal OPOUT to overshoot and undershoot the level needed to maintain Vout at its desired level.

With the circuitry of FIG. 6, overshoot and undershoot situations in OPOUT and Vout are detected using comparators 114 and 108 and corrective action is taken using overshoot compensation circuit 96 and undershoot compensation circuit 102.

Overshoot comparator 114 detects overshoot conditions by comparing the feedback voltage FB at input 116 to reference voltage VREFH at input 118 and generating a corresponding control signal CH on output line 120. The control signal CH is provided to the gate of transistor 100. When overshoot is detected, comparator 114 takes CH low. The signal CH is received at the gate of transistor 100. When CH goes low, transistor 100 is turned on, pulling signal OPOUT high. Signal OPOUT is applied to the gate of drive transistor 42, so when OPOUT is pulled high, the voltage Vout is lowered back towards its desired level. During the overshoot condition, the current carrying capacity of transistor 100 supplements the current drive capability of operational amplifier 24 and helps operational amplifier 24 to quickly drive OPOUT to an appropriate level.

Diode-connected transistor 98 in overshoot compensation circuit 96 serves as a voltage clamp. Transistor 98 forms a voltage drop of one transistor threshold voltage between positive power supply terminal 38 and node 124. Power supply terminal 38 may be powered using a power supply voltage Vccr. The presence of transistor 98 prevents signal OPOUT from reaching power supply voltage Vccr. If OPOUT were to rise to too high a voltage, PMOS drive transistor 42 might be shut off completely, which could lead to an undesirable turn-on delay. By preventing OPOUT from going too high, this turn-on delay is avoided.

Undershoot comparator 108 detects undershoot conditions by comparing the feedback voltage FB at input 112 to reference voltage VREFL at input 110. Based on this comparison, undershoot comparator 108 generates a control signal CL on output line 122. The control signal CL is provided to the gate of transistor 104 in undershoot compensation circuit 102. When undershoot is detected, comparator 108 takes CL high. The signal CL is received at the gate of transistor 104. When CL goes high, transistor 104 is turned on, pulling signal OPOUT low. Signal OPOUT is applied to the gate of drive transistor 42, so when OPOUT is pulled low, the voltage Vout is raised back towards its desired level. The current carrying capacity of transistor 104 supplements the current drive capability of operational amplifier 24 during undershoot conditions and helps operational amplifier 24 to quickly drive OPOUT to an appropriate level.

The rate at which voltage regulator circuitry 22 ramps up the voltage Vout on output line 80 during power-up operations can be controlled to prevent undesirable ringing in the output voltage Vout. Some loads 78 such as loads formed from an array of programmable memory elements 20 may contain storage elements formed from cross-coupled inverters. Control of the Vout ramp rate can help to prevent latch-up in the transistors of the cross-coupled inverters.

Figure 7:
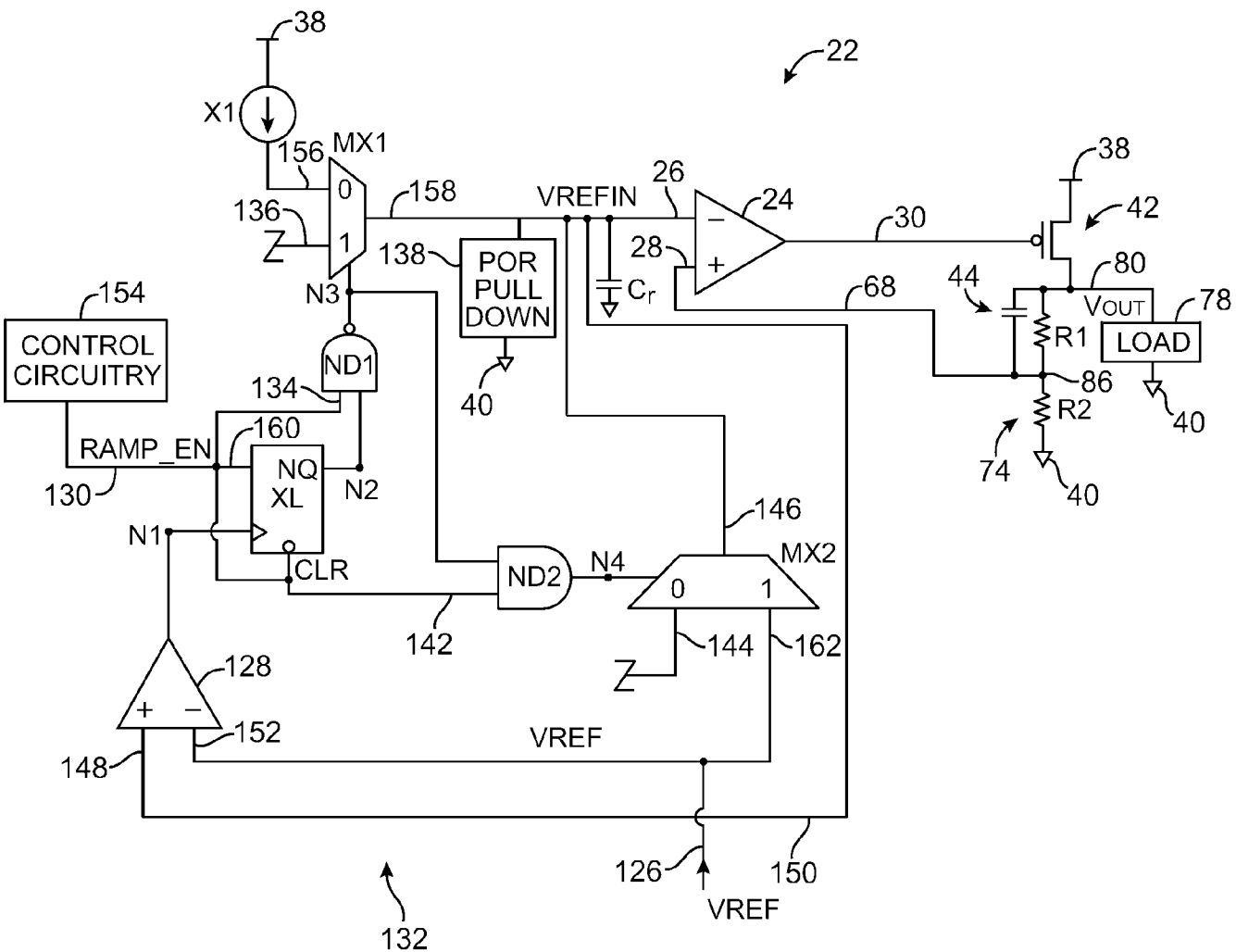
FIG. 7 is a diagram of an illustrative voltage regulator with circuitry for controlling its output voltage ramp rate in accordance with an embodiment of the present invention.

An illustrative voltage regulator 22 that contains circuitry for controlling the ramp rate of Vout is shown in FIG. 7. Voltage regulator 22 may be powered using positive power supply voltage terminals 38 and ground voltage terminals 40. A control circuit or other suitable voltage source may be used to provide a reference voltage VREF to voltage regulator 22. The reference voltage VREF may be received on line 126. The reference voltage VREF may, if desired, be changed as a function of time (e.g., to change the voltage at which a load is driven depending on the operating mode of device 10). The control circuitry that supplies VREF to path 126 may use a bandgap voltage reference or other suitable circuit to ensure reference voltage accuracy under a variety of process, voltage, and temperature conditions. The reference voltage VREF may be supplied to the "1" input of multiplexer MX2 and the negative input of comparator 128.

Operational amplifier 24 produces a control signal on output line 30 that is applied to the gate of drive transistor 42. The regulated output voltage signal Vout on line 80 is applied to load 78. Compensation capacitor 44 may be used to improve the stability of voltage regulator 22. If desired, voltage regulator 22 may use an adaptive compensation arrangement of the type described in connection with FIG. 2 and/or an undershoot/overshoot compensation arrangement of the type described in connection with FIG. 6. Feedback signal FB may be tapped from node 86 in voltage regulator 74. Operational amplifier 24 compares the feedback signal FB at input 28 to the reference voltage VREFIN at input 26 and produces a corresponding output signal on path 30 for controlling drive transistor 42. The value of reference voltage VREFIN is controlled by voltage ramp control circuitry 132.

Control circuitry 154 may supply a control signal RAMP_EN to input line 130. Initially, signal RAMP_EN is held low. With RAMP_EN low on line 130, input 134 to NAND gate ND1 is low. The low value of input 134 takes the output of NAND gate ND1 high, so node N3 is high. The high N3 signal enables the tristate input 136 of multiplexer MX1, so output 158 connected to line 26 is floating. Because RAMP_EN is low, the signal on input 142 of AND gate ND2 is low. With input 142 low, the output of AND gate ND2 on node N4 is taken low. The low N4 signal directs multiplexer MX2 to connect its tristate input 144 to its output 146. With the outputs of both MX1 and MX2 tristated, weak pull down circuit 138 pulls line 26 and signal VREFIN low.

The low RAMP_EN signal serves as a low clear signal CLR to flip flop XL, so flip flop XL is cleared and flip flop output NQ and node N2 are high.

The signal VREFIN is conveyed to input 148 of comparator 128 via path 150. Comparator 128 compares the signal VREFIN on input 148 to the signal VREF on input 152 and provides a corresponding output signal to node N1. VREF may be about 0.8 volts or any other suitable reference voltage level. Because the value of VREF (e.g., 0.8 volts) is greater than the value of VREFIN when VREFIN is low (e.g., 0 volts), the output of comparator 128 at node N1 is low.

When it is desired to ramp up the voltage Vout, control circuitry 154 takes signal RAMP_EN high. With node N2 high, taking RAMP_EN high at input 134 to NAND gate ND1 makes node N3 at the output of NAND gate ND1 go low. The low value of N3 is applied to the control input of multiplexer MX1 and configures multiplexer MX1 so that input 156 of multiplexer MX1 is connected to output 158 and input 26 of operational amplifier 24.

With input 156 connected to output 158, current from current source X1 flows through multiplexer MX1 into capacitor Cr, charging capacitor Cr and ramping up the value of VREFIN towards its desired value.

As ramping begins, node N3 is low, so node N4 is low and multiplexer MX2 is tristated. When VREFIN becomes greater than VREF, comparator 128 takes node N1 high. This clocks the high RAMP_EN input signal on input 160 of flip flop XL through flip flop XL and takes signal NQ low. When NQ is low, the voltage on node N2 is low. Signal N2 serves as an input to NAND gate ND1. When N2 goes low, the output N3 of NAND gate ND1 is taken high. The high value of N3 tristates multiplexer MX1 and blocks the current from current source X1. This stops the ramping process.

With node N3 high and RAMP_EN high, node N4 at the output of AND gate ND2 is high. The signal on node N4 serves as a control input to multiplexer MX2. With N4 high, input 162 is connected to output 146. In this configuration, reference voltage VREF is routed to input 26 through multiplexer MX2. Voltage regulator 22 can therefore operate normally, with VREF applied to input 26 and feedback signal FB applied to input 28 of operational amplifier 24.

The foregoing is merely illustrative of the principles of this invention and various modifications can be made by those skilled in the art without departing from the scope and spirit of the invention.

What is claimed is:

1. Voltage regulator circuitry for supplying a regulated voltage to a load, comprising:

at least one drive transistor that has a first terminal that receives a power supply voltage, a second terminal at which the regulated voltage is applied to the load, and a gate terminal that receives a control signal; and an operational amplifier having inputs and having an output at which the control signal is supplied to the gate terminal, wherein the operational amplifier comprises:

a first stage connected to the inputs;

a second stage connected to the output; and a conductive path between the first stage and the second stage, wherein the conductive path passes through an adjustable resistor and wherein the conductive path does not pass through a gate terminal and does not pass through a ground terminal.

2. The voltage regulator circuitry defined in claim 1 wherein the adjustable resistor comprises:

a first resistor;

a second resistor; and a transistor that bridges the second resistor.

3. The voltage regulator circuitry defined in claim 1 further comprising current sensing circuitry that determines how much current is flowing into the load and that adjusts the adjustable resistor based on the amount of current that is flowing into the load.

4. The voltage regulator circuitry defined in claim 1 further comprising overshoot and undershoot detection and compensation circuitry that determines when the regulated voltage overshoots and undershoots a desired voltage level and that helps to maintain the regulated voltage at the desired voltage level.

5. The voltage regulator circuitry defined in claim 1 further comprising voltage ramp control circuitry that controls how fast the regulated voltage is ramped up.

6. The voltage regulator circuitry defined in claim 1 further comprising:

overshoot and undershoot detection and compensation circuitry that determines when the regulated voltage overshoots and undershoots a desired voltage level and that helps to maintain the regulated voltage at the desired voltage level; and voltage ramp control circuitry that controls how fast the regulated voltage is ramped up.

7. The voltage regulator circuitry defined in claim 1 further comprising:

a voltage divider that is connected in series with the drive transistor; and a feedback path connected to the voltage divider that feeds back a feedback signal from the voltage divider to one of the inputs of the operational amplifier.

8. The voltage regulator circuitry defined in claim 1 wherein the adjustable resistor comprises:

a first resistor;

a second resistor;

a third resistor;

a first transistor that bridges the second resistor; and a second transistor that bridges the third resistor, wherein the first, second, and third resistors are connected in series.

9. The voltage regulator circuitry defined in claim 1 wherein the adjustable resistor comprises:

a first resistor;

a second resistor;

a third resistor;

a first transistor that bridges the second resistor; and a second transistor that bridges the third resistor, wherein the first, second, and third resistors are connected in series and wherein the voltage regulator circuitry further comprises:

current sensing circuitry that receives the control signal and that provides first and second voltages;

a first comparator that compares the first voltage to a reference voltage and that produces a first corresponding transistor control signal that controls the first transistor; and a second comparator that compares the second voltage to the reference voltage and that produces a second corresponding transistor control signal that controls the second transistor.

10. The voltage regulator circuitry defined in claim 1 wherein the adjustable resistor comprises a plurality of series-connected resistors, at least some of which are bridged by transistors, the voltage regulator circuitry further comprising:

current sensing and control circuitry that receives the control signal and that controls the transistors that bridge the resistors; and overshoot and undershoot detection and compensation circuitry that determines when the regulated voltage overshoots and undershoots a desired voltage level and that helps to maintain the regulated voltage at the desired voltage level.

11. The voltage regulator circuitry defined in claim 1 wherein the adjustable resistor comprises a plurality of series-connected resistors, at least some of which are bridged by transistors, the voltage regulator circuitry further comprising:

current sensing and control circuitry that receives the control signal and that controls the transistors that bridge the resistors; and voltage ramp control circuitry that controls how fast the regulated voltage is ramped up.

12. The voltage regulator circuitry defined in claim 1 wherein the adjustable resistor comprises a plurality of series-connected resistors, at least some of which are bridged by transistors, the voltage regulator circuitry further comprising:

current sensing and control circuitry that receives the control signal and that controls the transistors that bridge the resistors, wherein the current sensing and control circuitry comprises a plurality of branches each of which contains a respective voltage divider and each of which has an associated comparator that produces a respective transistor control signal to control a respective one of the transistors; and voltage ramp control circuitry that controls how fast the regulated voltage is ramped up, wherein the voltage ramp control circuitry comprises a current source and a capacitor.

13. Voltage regulator circuitry for supplying a regulated voltage to a load, comprising:

at least one drive transistor that has a first terminal that receives a power supply voltage, a second terminal at which the regulated voltage is applied to the load, and a gate terminal that receives a control signal; and an operational amplifier having inputs and having an output at which the control signal is supplied to the gate terminal, wherein the operational amplifier comprises:

a first stage connected to the inputs;

a second stage connected to the output;

an adjustable resistor between the first stage and the second stage, wherein the adjustable resistor comprises a plurality of series-connected resistors, at least some of which are bridged by transistors;

current sensing and control circuitry that receives the control signal and that controls the transistors that bridge the resistors;

overshoot and undershoot detection and compensation circuitry that determines when the regulated voltage overshoots and undershoots a desired voltage level and that helps to maintain the regulated voltage at the desired voltage level; and voltage ramp control circuitry that controls how fast the regulated voltage is ramped up.

14. The voltage regulator circuitry defined in claim 1, wherein one of the operational amplifier inputs receives a first reference voltage, the voltage regulator circuitry further comprising:

an overshoot comparator that receives a second reference voltage that is higher than the first reference voltage and that detects when the regulated voltage overshoots a desired voltage level;

an undershoot comparator that receives a third reference voltage that is lower than the first reference voltage and that detects when the regulated voltage undershoots the desired voltage level;

overshoot compensation circuitry that is connected to the operational amplifier output and that is responsive to an overshoot control signal from the overshoot comparator to help maintain the regulated voltage at the desired voltage level when the regulated voltage overshoots the desired voltage level; and undershoot compensation circuitry that is connected to the operational amplifier output and that is responsive to an undershoot control signal from the undershoot comparator to help maintain the regulated voltage at the desired voltage level when the regulated voltage undershoots the desired voltage level.

15. The voltage regulator circuitry defined in claim 1 wherein the load comprises an array of programmable memory elements, the voltage regulator circuitry further comprising:

a first resistor that is connected to the second terminal;

a second resistor that is connected to the first resistor at a node;

a feedback path that is connected between the node and one of the inputs of the operational amplifier.

16. The voltage regulator circuitry defined in claim 1 further comprising voltage ramp control circuitry that controls how fast the regulated voltage is ramped up, wherein the voltage ramp control circuitry comprises:

a current source; and a capacitor that is charged by the current source during ramp up operations, wherein the capacitor is coupled to one of the inputs of the operational amplifier.

17. Voltage regulator circuitry for supplying a regulated voltage to a load, comprising:

at least one drive transistor that has a first terminal that receives a power supply voltage, a second terminal at which the regulated voltage is applied to the load, and a gate terminal that receives a control signal;

an operational amplifier having inputs and having an output at which the control signal is supplied to the gate terminal, wherein the operational amplifier comprises:

a first stage connected to the inputs;

a second stage connected to the output; and an adjustable resistor between the first stage and the second stage; and voltage ramp control circuitry that controls how fast the regulated voltage is ramped up, wherein the voltage ramp control circuitry comprises:

a current source;

a capacitor; and a multiplexer that selectively connects the current source to the capacitor, wherein the capacitor is charged by the current source during ramp up operations and is coupled to one of the inputs of the operational amplifier.

18. The voltage regulator circuitry defined in claim 1 wherein the first stage has an output, wherein the second stage has an input, and wherein the output of the first stage is directly connected to the input of the second stage.

19. Voltage regulator circuitry for supplying a regulated voltage to a load, comprising:

at least one drive transistor that has a first terminal that receives a power supply voltage, a second terminal at which the regulated voltage is applied to the load, and a gate terminal that receives a control signal; and an operational amplifier having inputs and having an output at which the control signal is supplied to the gate terminal, wherein the operational amplifier comprises:

a first stage connected to the inputs;

a second stage connected to the output; and an adjustable resistor in a conductive path between the first stage and the second stage, wherein the first stage has an output, wherein the second stage has an output, and wherein the adjustable resistor has a first terminal that is coupled to the output of the first stage and has a second terminal that is coupled to the output of the second stage.

20. The voltage regulator circuitry defined in claim 19 wherein the operational amplifier further comprises a capacitor and wherein the capacitor is connected to one of the terminals of the adjustable resistor.

* * * * *